US007059797B2

(12) United States Patent
Sellars

(10) Patent No.: US 7,059,797 B2
(45) Date of Patent: Jun. 13, 2006

(54) SALES PROMOTIONAL WRITING INSTRUMENT

(76) Inventor: Joseph Sellars, 2423 W. 22nd St., Minneapolis, MN (US) 55405

( * ) Notice: Subject to any disclaimer, the term of this patent is extended or adjusted under 35 U.S.C. 154(b) by 0 days.

(21) Appl. No.: 10/619,807

(22) Filed: Jul. 15, 2003

(65) Prior Publication Data

US 2004/0028460 A1 Feb. 12, 2004

Related U.S. Application Data

(60) Provisional application No. 60/396,026, filed on Jul. 15, 2002.

(51) Int. Cl.
*B43K 29/00* (2006.01)
*B43K 23/02* (2006.01)

(52) U.S. Cl. ..... 401/195; 401/131

(58) Field of Classification Search ..... 401/52, 401/195, 131; D19/36, 46
See application file for complete search history.

(56) References Cited

U.S. PATENT DOCUMENTS

| | | | | |
|---|---|---|---|---|
| 0,245,257 | A | 8/1881 | Wright | |
| 555,752 | A * | 3/1896 | BachO | 401/20 |
| 2,961,257 | A | 11/1960 | Carr | |
| 3,846,927 | A * | 11/1974 | Geffen | 40/334 |
| 4,787,161 | A | 11/1988 | Feng | |
| 5,186,562 | A * | 2/1993 | Yoshinaga et al. | 401/112 |
| 5,308,179 | A | 5/1994 | Whitright | |
| 5,947,322 | A * | 9/1999 | Ho | 220/477 |
| 5,947,623 | A | 9/1999 | Smith | |
| 6,045,281 | A | 4/2000 | Bunn | |
| 6,308,380 | B1 * | 10/2001 | Cheng | 24/11 HC |
| 6,332,727 | B1 * | 12/2001 | Hsu | 401/195 |

* cited by examiner

*Primary Examiner*—David J. Walczak
(74) *Attorney, Agent, or Firm*—Patterson, Thuente, Skaar & Christensen

(57) ABSTRACT

A sales promotional writing instrument comprises features that simultaneously provides a point of sale marketing opportunity and discourages theft. Generally, the writing instrument comprises a body defining a longitudinal axis. The body includes an attachment member in a substantially transverse orientation to the longitudinal axis. The body includes a lumen adapted to receive a typical writing insert, such as a ballpoint pen cartridge. A display member includes at least one display surface and an insertion member. The insertion member is adapted for insertion into a cavity on the attachment member. The display member can include promotional marketing indicia such as trademarks, logos, slogans, advertisements, calendars and schedules on the display surface.

15 Claims, 6 Drawing Sheets

Fig. 8
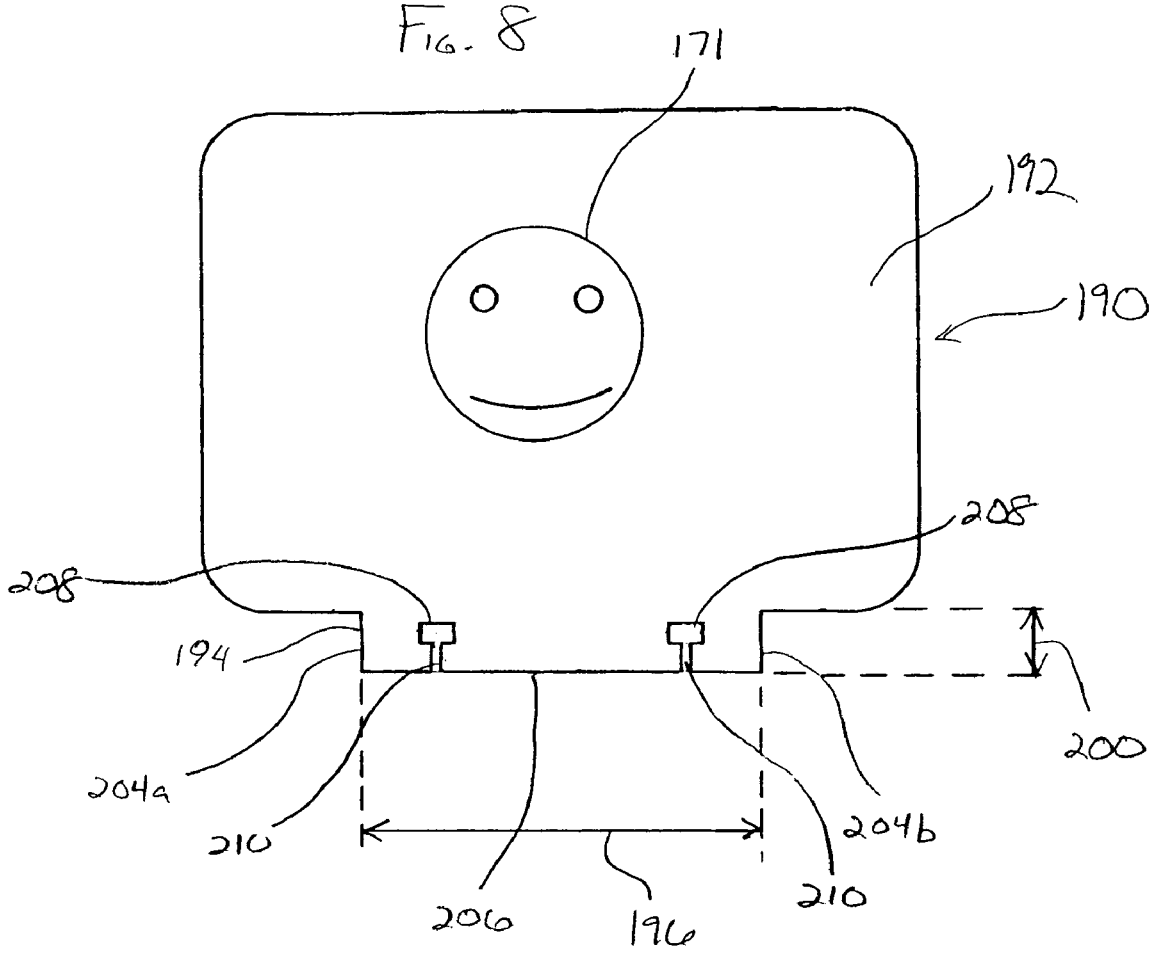
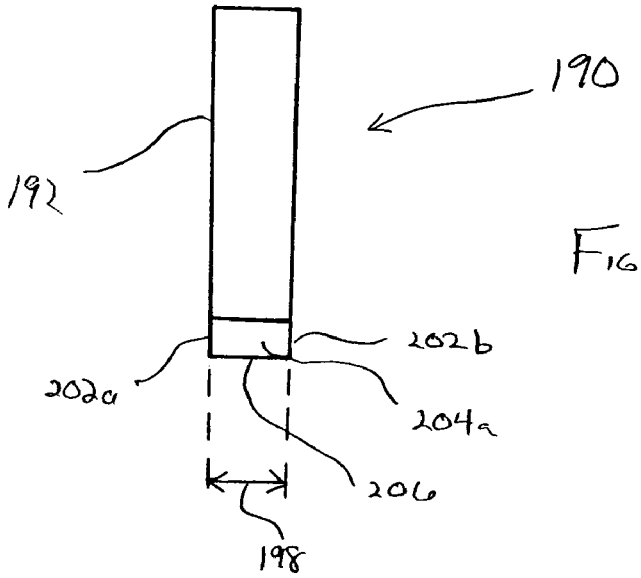
Fig. 9

SALES PROMOTIONAL WRITING INSTRUMENT

PRIORITY CLAIM

This application claims the benefit of U.S. Provisional Application No. 60/396,026, filed Jul. 15, 2002 entitled, "WRITING INSTRUMENT WITH ANTI-THEFT PROMOTIONAL DISPLAY", which is hereby incorporated by reference in its entirety.

TECHNICAL FIELD

The present invention relates generally to writing instruments. More particularly, the present invention relates to a writing instrument including a sales promotional display that assists in discouraging theft of the writing instrument.

BACKGROUND OF THE INVENTION

In many situations, it is desirable to provide customers with writing instruments such as to facilitate the customers' ability to complete forms. In stores, restaurants and gas stations, many of the standard transactions require the costumer's signature to complete the transaction. Examples of such forms include credit cart receipts or personal checks.

As the majority of consumers do not carry a writing instrument on their person, it is standard retail procedure to provide a writing instrument, usually a ballpoint pen, at the point of sale, for example on the sales counter. As fewer and fewer customers complete their transactions with cash payments, more and more customers use and are exposed to these retailer supplied writing instruments.

One downside of providing writing instruments to customers is that inevitably, a large percentage of the writing instruments are taken from the retailer. This taking can be from a purposeful theft but are just as likely to occur through an inadvertent action of the consumer. Even though the writing instruments can be replaced fairly inexpensive, the costs associated with continually replacing the writing instruments has encouraged businesses to take steps to reduce the likelihood that the writing instruments will be taken.

For example, many businesses attach the writing instruments to a string or chain, which is attached to an immovable object like a counter. Examples of these devices are set forth in U.S. Pat. Nos. 245,257; 2,961,257; and 5,947,623. A downfall of this technique is that the string or chain often impairs the ability of customers to use the writing instruments.

Another way businesses have sought to discourage customers from taking writing instruments has been to increase their dimensions. One common way to discourage theft is by simply taping a plastic spoon to the writing instrument. Other similar devices are set forth, for example, in U.S. Pat. No. 6,045,281 disclosing attachment of an anti-theft attachment to a premanufactured pen; U.S. Pat. No. 5,308,179 disclosing a writing instrument having a flower attached thereto and U.S. Pat. No. 4,787,161 disclosing a writing instrument having a flag attached thereto.

While the aforementioned examples provide some benefits, it would be advantageous to have a writing instrument that prevents theft while at the same time taking advantage of the marketing opportunity presented by increased use of such writing instruments.

SUMMARY OF THE INVENTION

The writing instrument of the present invention includes features that simultaneously providing a point of sale marketing opportunity while discouraging theft.

Generally, the writing instrument comprises a body defining a longitudinal axis. The body includes an attachment member that is preferably in a substantially transverse orientation to the longitudinal axis. The body also includes a lumen adapted to receive a typical writing insert, such as a ballpoint pen cartridge. A display member includes at least one display surface and an insertion member. The insertion member is adapted for insertion into a cavity on the attachment member.

The writing instrument of the present invention can include a base assembly for locating the writing instrument on a sales counter at the point of sale. The base assembly preferably includes a base surface with an attaching means as well as a mounting surface including at least one bore adapted for insertion of the writing instrument. The at least one bore is oriented at an angle to a base plane defined by the base surface such that the display member is positioned above the surface of the sales counter, such that the display portion is easily visible to the consumer.

The display member preferably includes sales promotional marketing indicia on the display surface. For example, the indicia can include visuals objects such as trademarks, logos, slogans, advertisements, calendars and schedules. The indicia can be permanently affixed to the display member as by molding or painting or can be removable affixed such as by insertion behind a transparent cover or through removable sticking means.

The writing instrument can include a display member that is permanently attached to the attachment member. The display member can also be removably attached to the attachment member allowing display members to be replaced as new promotions or products are introduced.

The present invention also comprises a method for presenting sales promotional materials at the point of sale. The method includes supplying a base member adapted to hold a writing member such that a display member is visible displayed to the consumer.

BRIEF DESCRIPTION OF THE DRAWINGS

FIG. 8 is a front view of an embodiment of a removable display member.

FIG. 9 is a side view of the display member of FIG. 8.

DETAILED DESCRIPTION OF THE DRAWINGS

Figure 1:
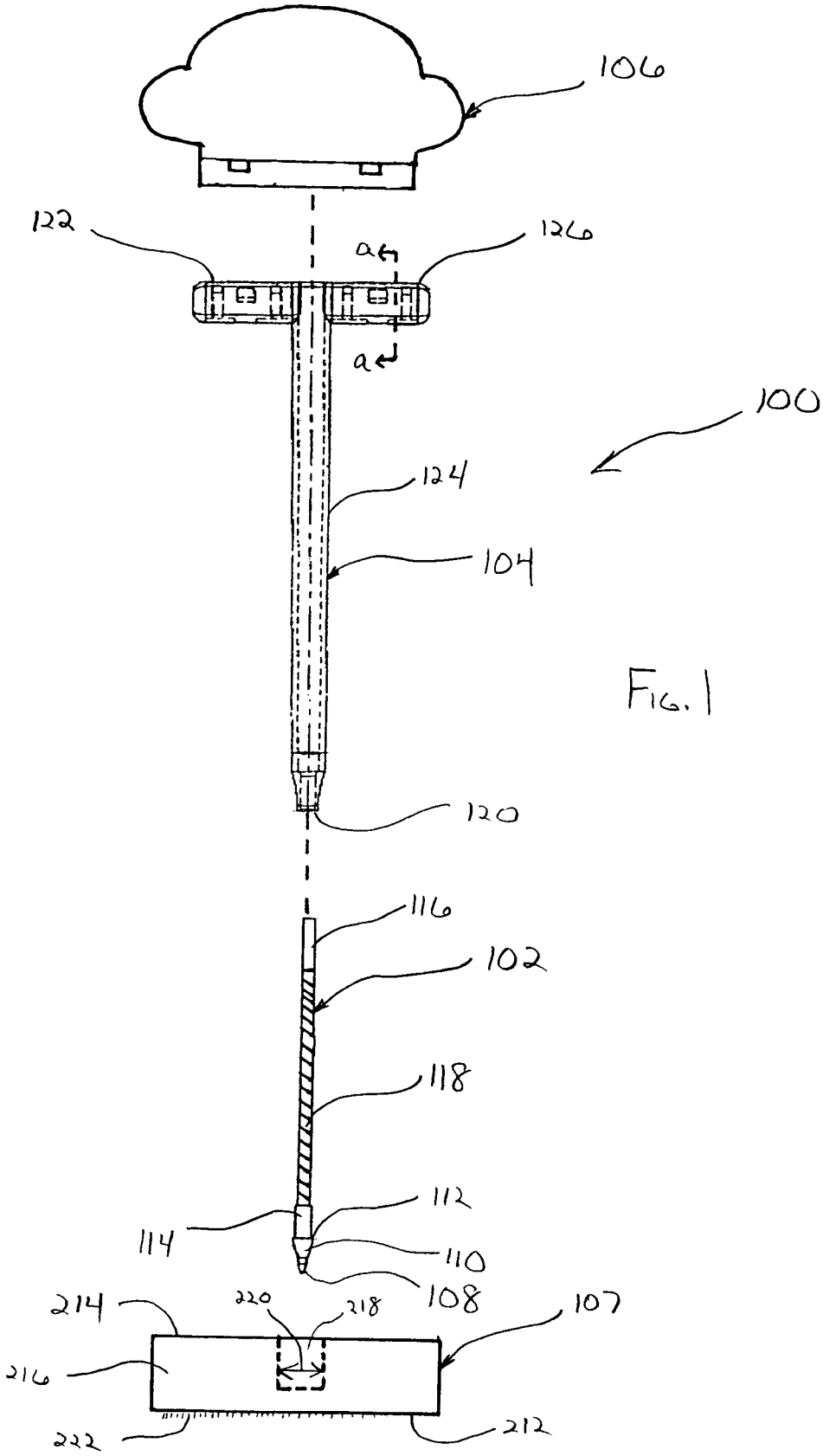
FIG. 1 is an exploded front sectional view of a sales promotional writing instrument of the present invention.

Depicted in FIG. 1 is a sales promotional writing instrument 100 of the present invention. Generally, writing instrument 100 is comprised of a writing insert 102, an instrument body 104 and a display member 106. Preferably, writing instrument 100 is retainably held by a base member 107 when not in use.

As shown in FIG. 1, writing insert 102 comprises a tip 108, a tip support 110, a positioning flange 112, a sealing surface 114 and an elongated storage lumen 116. Most preferably, tip 108 comprises a ballpoint design. Most preferably, storage lumen 116 contains an amount of ink 118 suitable for even distribution by tip 108.

Figure 2:
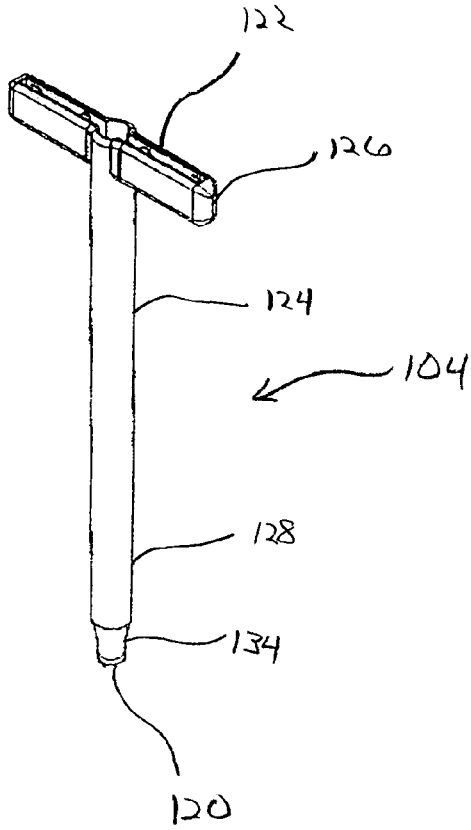
FIG. 2 is a top perspective view of a body of the writing instrument.

Also shown in FIG. 2, instrument body 104 includes a writing end 120 and a display end 122. In a preferred embodiment, writing end 120 and display end 122 are injection molded such that instrument body 104 is a single, integrated structure. Instrument body 104 is comprised of a hollow, elongated gripping member 124 and an attachment member 126 that is preferably in a transverse orientation to the gripping member 124.

A person or ordinary skill in the art will appreciate that it is possible to orient attachment member 126 in other orientations with respect to gripping member 124. For example, attachment member 126 may be substantially parallel to gripping member 124.

Figure 3:
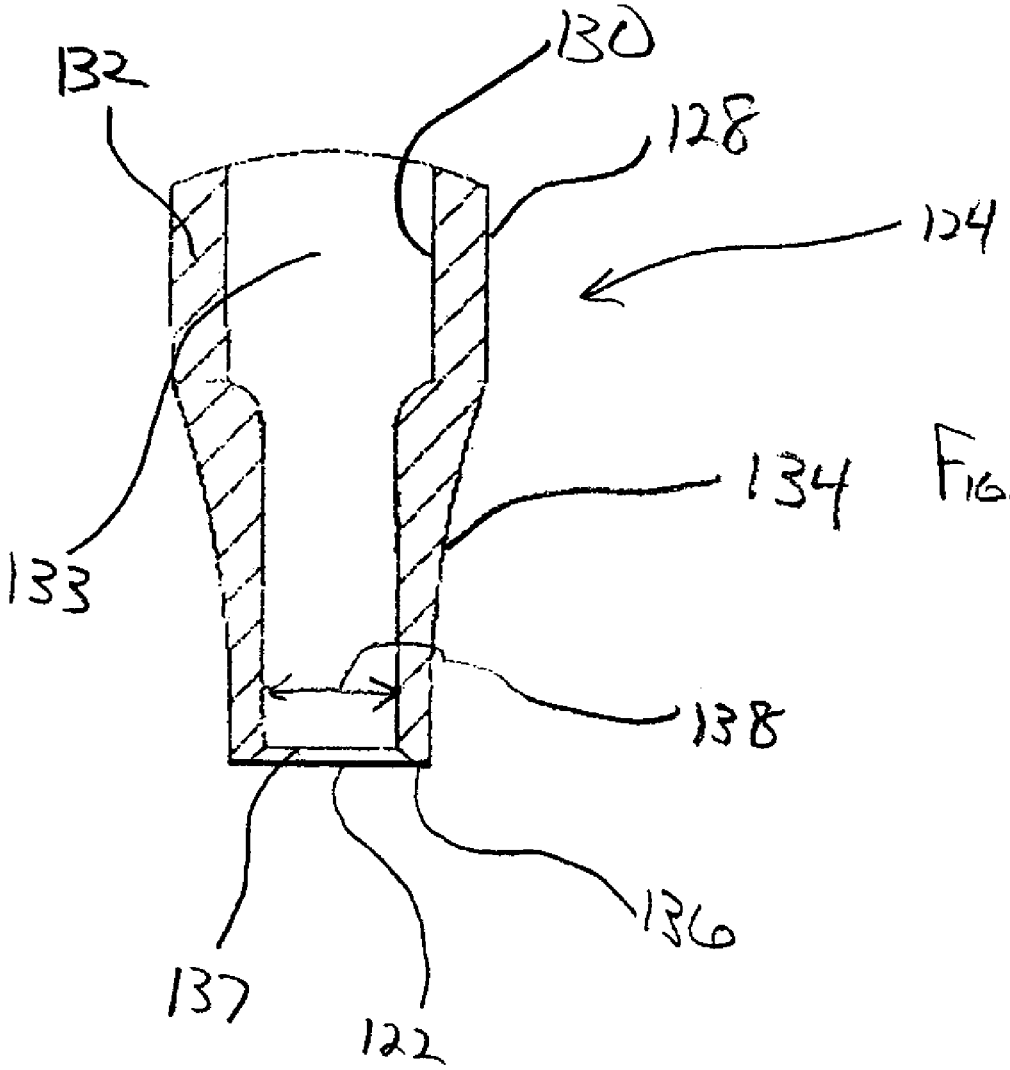
FIG. 3 is a sectional view of a writing end of the body.

As is more clearly illustrated in FIG. 3, gripping member 124 includes an external surface 128 and an internal surface 130 defining a utensil wall 132. Generally, internal surface 130 defines an internal lumen 133 along the longitudinal axis of instrument body 104 defined by gripping member 124.

Proximate the writing end 120, external surface 128 and internal surface 130 both taper inwardly to define a gripping surface 134. At the writing end 120, utensil wall 132 terminates in an insertion flange 136. At tapered gripping surface 134, the internal surface 130 defines an insertion opening 137 having an insertion diameter 138. In a preferred embodiment, insertion diameter 138 is slightly larger than the diameter of sealing surface 114.

Figure 4:
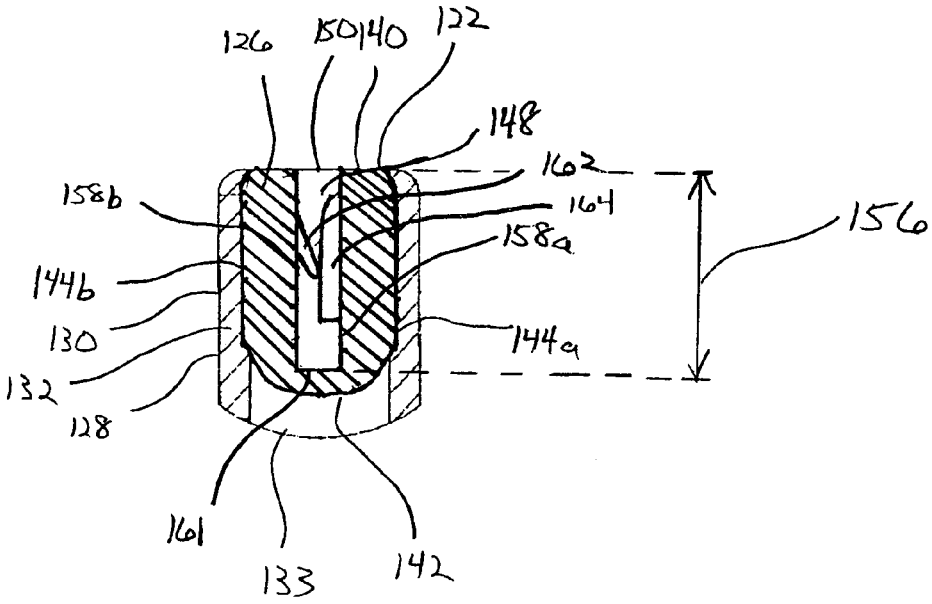
FIG. 4 is a sectional view of a display end of the body taken along line a—a of FIG. 1.
Figure 5:
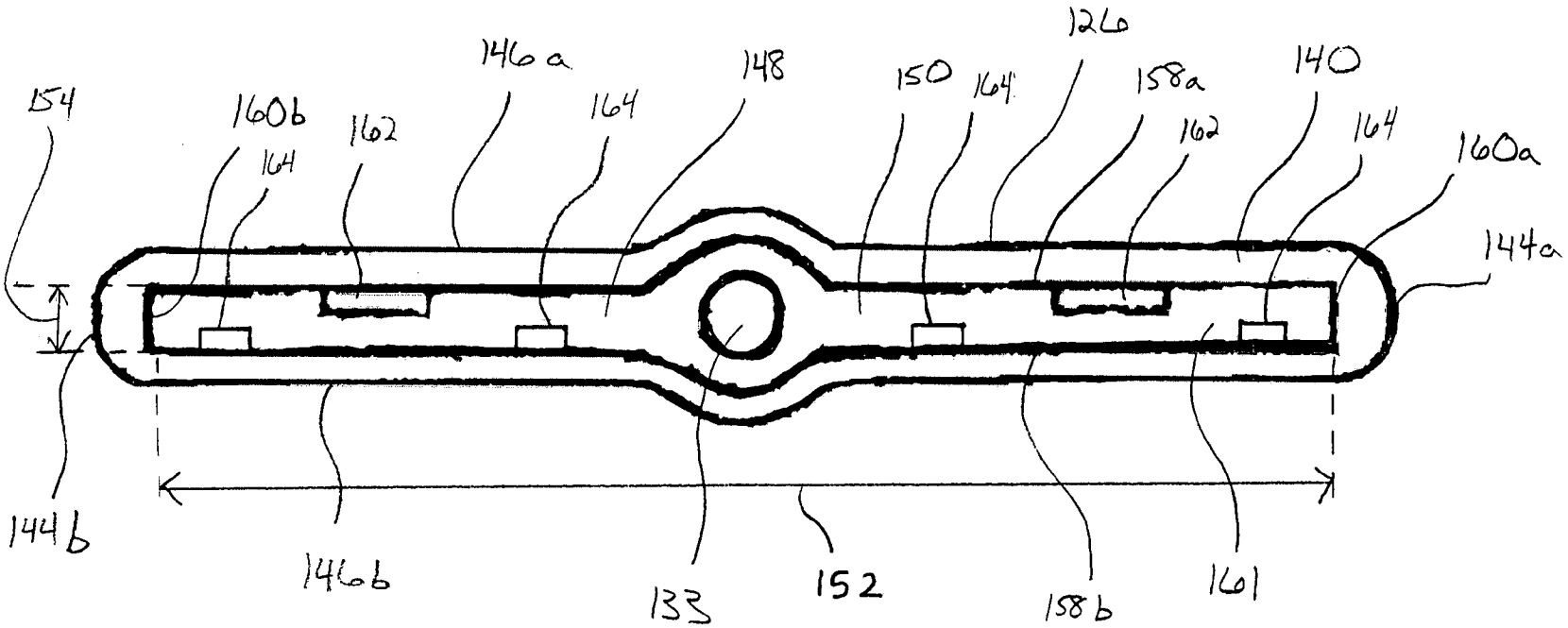
FIG. 5 is a top view of the display end of the body.

As illustrated in FIGS. 2, 4 and 5, attachment member 126 comprises a top surface 140, a bottom surface 142, a pair of side surfaces 144*a*, 144*b* and a pair of end surfaces 146*a*, 146*b*. Attachment member 126 includes an insertion cavity 148 with an opening 150 in the top surface 140. Opening 150 is defined by an opening length 152, an opening width 154 and an opening depth 156. Opening 150 has a pair of side walls 158*a*, 158*b* and a pair of end walls 160*a*, 160*b* and a bottom wall 161.

Generally, bottom wall 161 and interior storage space 133 intersect such that a continual opening is defined from writing end 120 to display end 122. An embodiment shown in FIG. 4 depicts opening 150 including at least one locking member 162 depicted as a projecting tab. On the opposing side wall 158*b*, opening 150 includes at least one spaced apart biasing member 164 depicted as a projecting rib.

Figure 6:
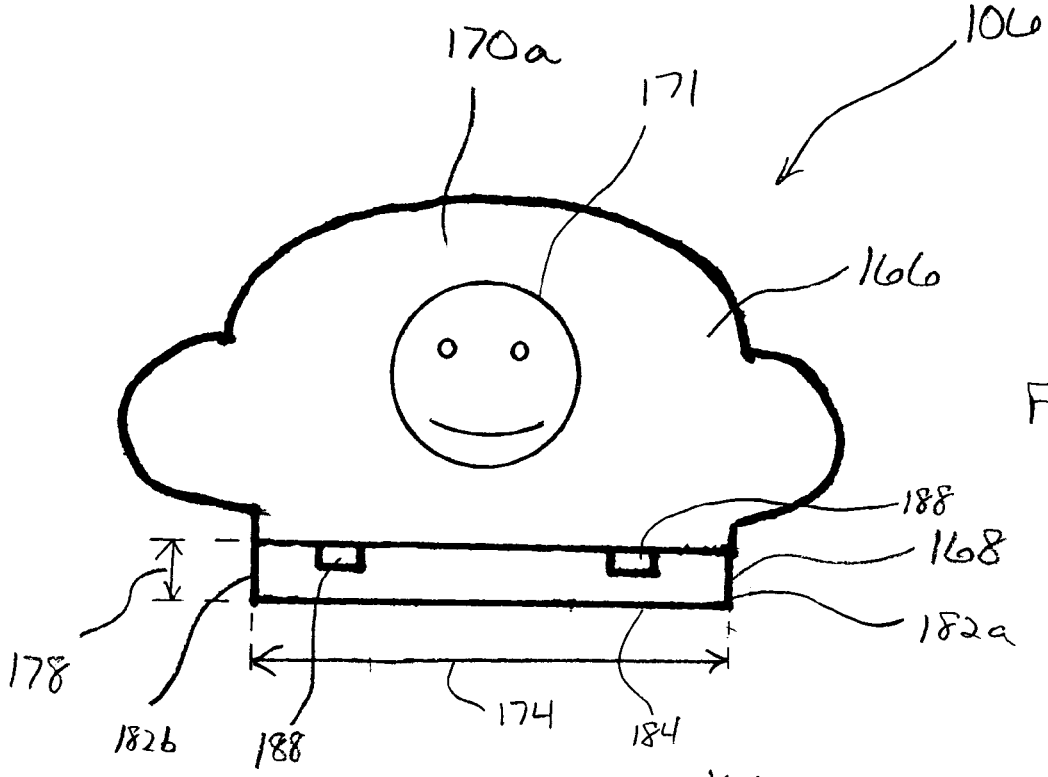
FIG. 6 is a front view of an embodiment of a permanent display member.
Figure 7:
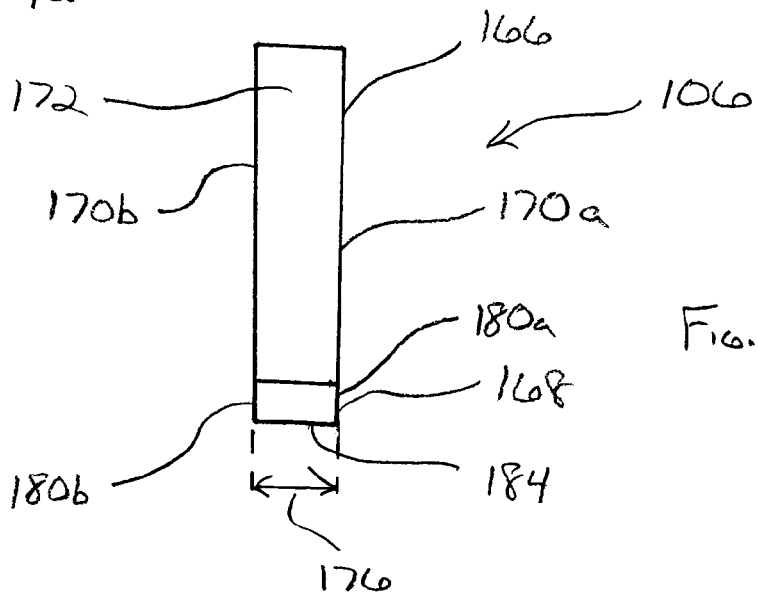
FIG. 7 is a side view of the display member of FIG. 6.

As depicted in FIGS. 6 and 7, the display member 106 is comprised of a visual portion 166 and an insertion member 168. Display member 106 preferably comprises a resilient plastic sheet but could also comprise paper, cardboard or other similar materials. Visual portion 166 most typically comprises a pair of display surfaces 170*a*, 170*b* in a parallel orientation to each other separated by a display wall 172.

Alternatively, the visual portion 166 can comprise multiple display surfaces, such as a triangle, cube or other geometric shape, or visual portion 166 can comprise a single display surface, for example a sphere or a globe. As depicted in FIG. 6, display surface 170*a* includes marketing indicia 171 in the form of a smiling face. Insertion member 168 is defined by an insertion length 174, an insertion width 176 and an insertion height 178.

Insertion member 168 includes a pair of insertion sides 180*a*, 180*b*, a pair of insertion ends 182*a*, 182*b* and an insertion bottom surface 184. As depicted, insertion side 180*a* includes at least one receiving member 188 depicted as a recess. Alternatively, the at least one receiving member 188 can take the form of a bore or other suitable receiving shape. Insertion length 174 and insertion width 176 define an insertion profile slightly less than opening 150.

Another embodiment of a breakaway display member 190 for use with writing utensil 104 is depicted in FIG. 8. Display member 190 comprises at least one display surface 192, including marketing indicia 171, and an insertion member 194. Insertion member 194 has an insertion length 196, an insertion width 198 and an insertion height 200.

Insertion member 194 includes a pair of insertion sides 202*a*, 202*b*, a pair of insertion ends 204*a*, 204*b* and an insertion bottom surface 206. As depicted, insertion member 194 includes at least one receiving member 208 depicted as an opening. Receiving member 208 includes a slot 210 interconnecting the receiving member 208 and the bottom surface 206. Connecting length 196 and connecting width 198 define a connecting profile slightly less than opening 150.

As shown in FIG. 1, base member 107 is typically defined by a base surface 212, mounting surface 214 and at least one base side 216, for example a base side 216 defining a circular shape. At least one bore 218 is located within mounting surface 214. Bore 218 has a bore diameter 220 dimensioned to accommodate instrument body 104.

Bore 218 is oriented at an angle to a base plane defined by the base surface 212 such that the display member 106 is always positioned above base member 107. Base surface 212 most typically comprises an attaching means 222, such as an adhesive or a material having complemental parts which adhere to each other when pressed together and marketed under the trademark VELCRO™, to fixedly attach the base member 107 to a sales counter. A person of ordinary skill in the art will appreciate that the mounting surface 214 may extend above base member 107 such as in a cylindrical tube.

In actual use, sales promotional, anti-theft writing instrument 100 of the present invention is assembled by slidably inserting writing insert 102 into writing end 120 while display member 106 is slidingly inserted into display end 122. Writing insert 102 is positioned as shown in FIG. 1 such that storage lumen 116 is aligned with insertion opening 137. Storage lumen 116 is slidingly inserted into insertion opening 137 until positioning flange 112 engages insertion flange 136.

Writing insert 102 most typically remains positioned within instrument body 104 due to an interference fit between sealing surface 114 and internal surface 130, where internal surface 130 defines insertion diameter 138. In alternative embodiments, writing insert 102 and instrument body 104 can be threadably engagable by including threaded portions on both the sealing surface 114 and the internal surface 130, where internal surface 130 defines insertion diameter 138.

Display member 106 is removably attachable to instrument body 104 at attachment member 126. Display member 106 is positioned such that the profile of the insertion member 168 is aligned with opening 150. Insertion member 168 slidingly inserts into opening 150. As insertion member 168 enters insertion cavity 148, biasing member 164 forces the insertion member 168 against locking member 162 such that locking member 162 is compressed against side wall 158*b*.

When insertion member 168 is fully inserted such that insertion bottom surface 184 is in contact with bottom wall 161, receiving member 188 is exposed to the locking member 162 allowing locking member 162 to retainably position itself within receiving member 188. Locking member 162 abuts a bottom edge of the receiving member 188 such that display member 106 is locked within opening 150.

When fully assembled, sales promotional writing instrument 100 comprises a large, irregular shape as opposed to typical pens and pencils. This large, irregular shape serves several functions. First, the large, oversized shape of the display member 106 provides a retail establishment with a marketing opportunity at the point of sale. Second, the shape of sales promotional writing instrument 100 helps to eliminate the chances that a customer or user will mistakenly place the instrument in their pocket by presenting a shape that is difficult to unintentionally place in a typical clothes pocket. Third, the shape of the sales promotional writing instrument 100 makes it more difficult for a person who is intentionally taking the instrument to hide or disguise the theft.

With respect to the marketing opportunity at the point of sale, display member 106 includes display surfaces 170*a*, 170*b* that are ideal locations for placing marketing indicia 171, for example a trademark, logo, slogan, calendar, schedule, advertisement or other visual marketing strategy. As such, display member 106 can comprise a variety of different embodiments. In the embodiment as depicted in FIGS. 1, 6 and 7, display member 106 can be a completely molded assembly that includes marketing indicia 171, such as a trademark, logo or slogan, molded into display surfaces 170*a*, 170*b*.

Alternatively, display surfaces 170*a*, 170*b* can be blank allowing for marketing indicia 171, such as a company trademark, logo, slogan, calendar, schedule or advertisement, to be painted or stuck on to the display member 106. Finally, display surfaces 170*a*, 170*b* could include a recessed display area in conjunction with a pair of slots within the display wall 172 allowing slips of plastic or paper to be slidingly inserted and removed from the recessed display areas such that marketing indicia 171 such as logos, trademarks or advertisements could be updated or changed periodically.

Depending on the marketing media used on display member 106, it may be advantageous to remove a first display member and replace it with a dimensionally identical second display member having a new or updated marketing media. Through the use of display member 190 in FIGS. 8 and 9, a user can simply rip or break-away display member 190 from instrument body 104 and replace it with a dimensionally similar display member.

Display member 190 is removable by grasping the at least one display surface 192 and pulling display member 190 away from instrument body 104. Slot 210 substantially weakens the at least one receiving member 210 such that a portion of insertion bottom surface 206 breaks away such that the at least one locking member 162 no longer retainably grasps the receiving member 210 allowing insertion member 194 to be slidingly removed from internal cavity 148. A second display member can then be slidingly inserted into insertion cavity 148 as previously described.

It is contemplated that features disclosed in this application, as well as those described in the above applications incorporated by reference, can be mixed and matched to suit particular circumstances. Various other modifications and changes will be apparent to those of ordinary skill in the art.

The invention claimed is:

1. A sales promotional writing apparatus comprising:

a writing member comprising a body defining a longitudinal axis and an attachment member in a substantially transverse orientation to the longitudinal axis, the body including a lumen adapted to fixedly receive a writing insert, the attachment member including a cavity exposed in an attachment surface, the cavity including at least one locking member;

a display member comprising at least one display surface and an insertion member, the insertion member having an insertion profile adapted for insertion into the cavity, the insertion member further comprising at least one receiving member adapted to receive the at least one locking member, wherein the cavity further includes a biasing member adapted to direct the at least one locking member into the at least one receiving member;

a base member having a base surface and a mounting surface, the mounting surface including at least one mounting bore oriented at an angle to a base plane defined by the base surface, wherein the base surface includes an attachment means for fixedly attaching the base member to a sales counter.

2. The sales promotional writing apparatus of claim 1, wherein the writing insert comprises a ballpoint pen cartridge.

3. The sales promotional writing apparatus of claim 1, wherein the at least one display surface comprises marketing indicia.

4. The sales promotional writing apparatus of claim 3, wherein the marketing indicia is selected from the group consisting of: trademarks, logos, slogans, calendars, schedules and advertisements.

5. A sales promotional writing apparatus comprising:

a writing member comprising a body defining a longitudinal axis and an attachment member in a substantially transverse orientation to the longitudinal axis, the body including a lumen adapted to fixedly receive a writing insert, the attachment member including a cavity exposed in an attachment surface, the cavity including at least one locking member; and a display member comprising at least one display surface and an insertion member, the insertion member having an insertion profile adapted for insertion into the cavity, the insertion member further comprising at least one receiving member adapted to receive the at least one locking member, wherein the cavity further includes a biasing member adapted to direct the at least one locking member into the at least one receiving member.

6. The sales promotional writing apparatus of claim 5, wherein the at least one locking member and the at least one receiving member cooperate to permanently attach the writing member and the display member.

7. A method for presenting sales promotional marketing materials to a consumer at a point of sale, the method comprising the steps of:

attaching a base member to a sales counter, the base member having a base surface and a mounting surface, the base surface including attachment means for fixedly attaching the base member to the sales counter, the mounting surface including at least one bore oriented at an angle to the base surface;

inserting a writing member into the bore, the writing member comprising a body and a display portion, the body defining a longitudinal axis and an attachment member in a substantially transverse orientation to the longitudinal axis, the body further including a lumen adapted to fixedly receive a writing insert, the display portion comprising at least one display surface including a marketing indicia and an insertion member having a locking member, the insertion member adapted to slidably insert into a cavity presented on an attachment surface of the attachment member such that the locking member interacts with a receiving member within the cavity, wherein the cavity further includes a biasing member adapted to direct the at least one locking member into the at least one receiving member, and wherein the marketing indicia includes an advertisement;

removing the display portion from the body; and attaching a second display portion to the body, the second display portion including a second insertion member adapted for slidable insertion into the cavity on the attachment member.

8. The method of claim 7, wherein the writing insert comprises a ballpoint pen cartridge.

9. A method for presenting sales promotional marketing materials to a consumer at a point of sale, the method comprising the steps of:

attaching a base member to a sales counter, the base member having a base surface and a mounting surface, the base surface including attachment means for fixedly attaching the base member to the sales counter, the mounting surface including at least one bore oriented at an angle to the base surface;

inserting a writing member into the bore, the writing member comprising a body and a display portion, the body defining a longitudinal axis and an attachment member in a substantially transverse orientation to the longitudinal axis, the body further including a lumen adapted to fixedly receive a writing insert, the display portion comprising at least one display surface including a marketing indicia and an insertion member having a locking member, the insertion member adapted to slidably insert into a cavity presented on an attachment surface of the attachment member such that the locking member interacts with a receiving member within the cavity;

removing the display portion from the body; and attaching a second display portion to the body, the second display portion including a second insertion member adapted for slidable insertion into the cavity on the attachment member.

10. The method of claim 9, wherein the marketing indicia is selected from the group consisting of: trademarks, logos, slogans, calendars, schedules and advertisements.

11. A method for presenting sales promotional marketing materials to a consumer at a point of sale, the method comprising the steps of:

attaching a base member to a sales counter, the base member having a base surface and a mounting surface, the base surface including attachment means for fixedly attaching the base member to the sales counter, the mounting surface including at least one bore oriented at an angle to the base surface;

inserting a writing member into the bore, the writing member comprising a body and a display portion, the body defining a longitudinal axis and an attachment member in a substantially transverse orientation to the longitudinal axis, the body further including a lumen adapted to fixedly receive a writing insert, the display portion comprising at least one display surface including a marketing indicia and an insertion member having a locking member, the insertion member adapted to slidably insert into a cavity presented on an attachment surface of the attachment member such that the locking member interacts with a receiving member within the cavity, wherein the cavity further includes a biasing member adapted to direct the at least one locking member into the at least one receiving member.

12. A sales promotional writing apparatus comprising:

a writing member comprising a body defining a longitudinal axis and an attachment member, the body including a lumen adapted to fixedly receive a writing insert, the attachment member including a cavity exposed in an attachment surface, the cavity including at least one locking member; and a display member comprising at least one display surface and an insertion member, the insertion member having an insertion profile adapted for insertion into the cavity, the insertion member further comprising at least one receiving member adapted to receive the at least one locking member, wherein the cavity further includes a biasing member adapted to direct the at least one locking member into the at least one receiving member.

13. The sales promotional writing apparatus of claim 12, wherein the at least one locking member and the at least one receiving member cooperate to permanently attach the writing member and the display member.

14. The sales promotional writing apparatus of claim 12, wherein the at least one receiving member includes a releasing means such that the display member is removably attached to the writing member.

15. A sales promotional writing apparatus comprising:

a writing member comprising a body defining a longitudinal axis and an attachment member in a substantially transverse orientation to the longitudinal axis, the body including a lumen adapted to fixedly receive a writing insert, the attachment member including a cavity exposed in an attachment surface, the cavity including at least one locking member; and a display member comprising at least one display surface and an insertion member attached to the display member, the insertion member having an insertion profile adapted for insertion into the cavity, the insertion member further comprising at least one receiving member adapted to receive the at least one locking member, wherein the cavity further includes a biasing member adapted to direct the at least one locking member into the at least one receiving member.

* * * * *